US005618354A

United States Patent [19]

Lofaro

[11] Patent Number: 5,618,354

[45] Date of Patent: Apr. 8, 1997

[54] APPARATUS AND METHOD FOR CARRIER BACKING FILM RECONDITIONING

[75] Inventor: Michael F. Lofaro, Milton, N.Y.

[73] Assignee: International Business Machines Corporation, Armonk, N.Y.

[21] Appl. No.: 642,830

[22] Filed: May 3, 1996

Related U.S. Application Data

[62] Division of Ser. No. 382,724, Feb. 2, 1995, Pat. No. 5,558, 111.

[51] Int. Cl.[6] ..... B08B 11/02

[52] U.S. Cl. ..... 134/25.4; 134/104.1; 134/902; 451/287; 451/388

[58] Field of Search ..... 134/104.1, 902, 134/153, 147, 25.4; 451/388, 289, 287

[56] References Cited

U.S. PATENT DOCUMENTS

| | | | |
|---|---|---|---|
| 3,436,789 | 4/1969 | Hays . | |
| 4,064,885 | 12/1977 | Dussault et al. | 134/902 |
| 4,104,099 | 8/1978 | Scherrer . | |
| 4,239,567 | 12/1980 | Winings . | |
| 4,466,852 | 8/1984 | Beltz et al. . | |
| 4,544,446 | 10/1985 | Cady | 134/902 |
| 4,680,893 | 7/1987 | Cronkhite et al. | 451/287 |
| 4,705,438 | 11/1987 | Zimmerman et al. | 451/388 |
| 5,154,021 | 10/1992 | Bombardier et al. . | |
| 5,180,431 | 1/1993 | Sugimoto et al. . | |
| 5,230,184 | 7/1993 | Bukhman . | |
| 5,246,525 | 9/1993 | Sato . | |
| 5,320,706 | 6/1994 | Blackwell . | |
| 5,349,978 | 9/1994 | Sago et al. . | |
| 5,351,360 | 10/1994 | Suzuki et al. . | |
| 5,443,416 | 8/1995 | Volodarsky et al. . | |
| 5,449,316 | 9/1995 | Strasbaugh | 451/388 |
| 5,487,398 | 1/1996 | Ohmi et al. . | |

FOREIGN PATENT DOCUMENTS

| | | | |
|---|---|---|---|
| 63-144955 | 6/1988 | Japan . | |
| 2-284421 | 11/1990 | Japan . | |
| 5-116067 | 5/1993 | Japan | 451/287 |

OTHER PUBLICATIONS

Holley, et al., "Extending Polishing Pad Life", IBM Technical Disclosure Bulletin V21 N12, May 1979, p. 4830.

*Primary Examiner*—Frankie L. Stinson
*Attorney, Agent, or Firm*—Whitham, Curtis, Whitham & McGinn; Alison Mortinger, Esq.

[57] ABSTRACT

An apparatus and method for cleaning and reconditioning a wafer carrier backing film. The apparatus comprises a flat perforated surface plate with a perforated film or perforated embossed glass plate on its surface; a backing plate connected to the surface plate which is fitted for connection to a cleaning solution supply and a vacuum source; and a contacting mechanism for extension/retraction of the surface plate until it contacts the carrier backing film. Following a wafer unload cycle, the carrier backing film is reconditioned by spraying a cleaning solution at the carrier backing film so as to rinse slurry deposits from the film material; extending the surface plate to make sealed contact with the wafer carrier; initiating a vacuum condition to press the carrier backing film and draw out slurry residuals and excessive water content from within the film; and retracting the surface plate to reconstitute the film as the material draws in surrounding air to break the vacuum condition.

5 Claims, 8 Drawing Sheets

APPARATUS AND METHOD FOR CARRIER BACKING FILM RECONDITIONING

CROSS REFERENCE TO RELATED APPLICATION

This application is a divisional of application Ser. No. 08/382,724 filed Feb. 2, 1995 now U.S. Pat. No. 5,558,111.

BACKGROUND OF THE INVENTION

1. Field of the Invention

The present invention generally relates to insulator and metal polishing operations performed in the processing of semiconductor wafers and, more particularly, to a method and apparatus for reconditioning the carrier backing film between polishing operations to maintain the uniformity and planarity of the polish on a wafer-to-wafer basis.

2. Description of the Prior Art

Insulator and metal polish operations performed in the processing of semiconductor wafers are performed on commercially available polishers, such as the Westech 372/372M polishers. These polishers have wafer carriers with an insert, or carrier backing film, which acts as the holding device during transport of the wafer to and from the polishing pad, as well as during the polish cycle. A carrier backing film that is widely used is the Rodel DF-200 product which is of a spongè-like composition. The DF-200 product is a buffed poromeric film having a thickness of about 0.013" to 0.017" that is laminated to mylar for greater dimensional stability. The resulting DF-200 thickness is about 0.024" to 0.028" with a compressibility of about 7 to 23 percent, and is standardized for 2", 3", 3.25", 100 mm, 125 mm, or 150 mm wafers.

The ability to establish and maintain the uniformity and planarity of the polish on a wafer-to-wafer basis is difficult. The degradation of the carrier backing fill—caused in part by the build up of slurry deposits in the film during the polish process—is a major contributor of polishing non-uniformity. Also, the film tends to collapse over time causing polish process results to deviate on a wafer-to-wafer basis. This degradation is time-dependent, yet unpredictable, and nearly always unrecoverable.

In light of the foregoing, there exists a need for a reliable reconditioning device and method of reconditioning the carrier backing film between polishing operations.

SUMMARY OF THE INVENTION

The present invention is directed to a reconditioning apparatus for a carrier backing film, and a method of reconditioning the carrier backing film between polishing operations, which substantially obviates one or more of the problems due to the limitations and disadvantages of the related art.

To achieve these and other advantages and in accordance with the purpose of the invention, as embodied and broadly described, the invention provides for a reconditioning apparatus that has a flat perforated surface plate; a backing plate connected to the surface plate which is fitted for connection to a cleaning solution supply and a vacuum source; and a contacting means for extension or retraction of the surface plate. A perforated thin film or perforated embossed glass plate is placed on the top surface of the surface plate.

In another aspect, the invention provides for a method of reconditioning a carrier backing film following a wafer unload cycle, comprising the steps of: (1) applying a spray of a cleaning solution to the carrier backing film so as to rinse slurry deposits from the film material; (2) extending the surface plate to make sealed contact with the wafer carrier; (3) applying a vacuum which provides the dual functions of "pressing" the carrier backing film, thereby redistributing its membrane and any water content uniformly throughout, as well as drawing out any possible buildup of slurry residuals and excessive water content from within the cavities of the membrane; and (4) retracting the surface plate thereby separating the carrier backing film from the surface plate film so as to provide an expansion or reconstitution of the carrier backing film as the material draws in surrounding air to break the vacuum hold.

It is to be understood that both the foregoing general description and the following detailed description are exemplary and explanatory and are intended to provide further explanation of the invention as claimed.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF AN EMBODIMENT OF THE INVENTION

Figure 1A:
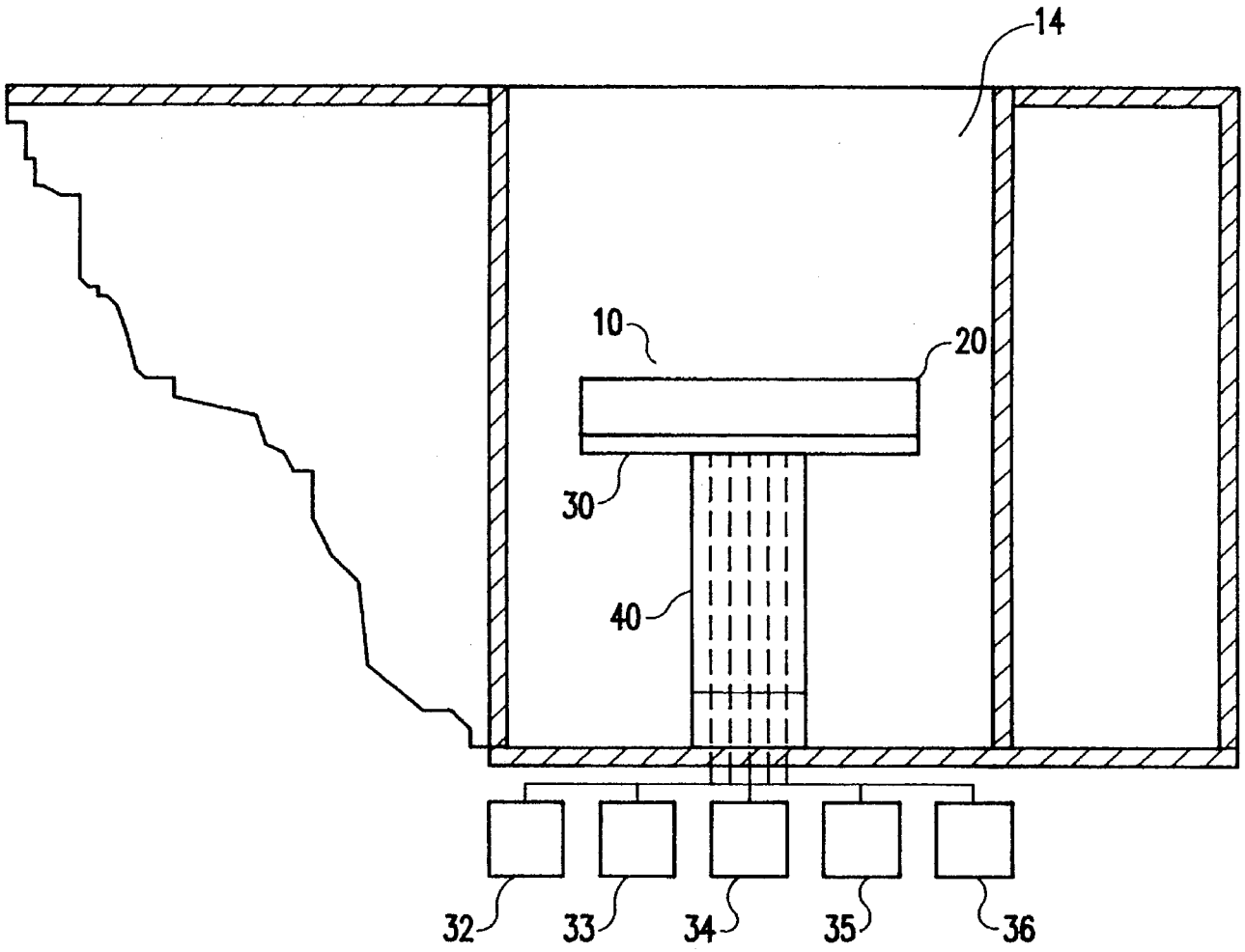
FIG. 1A is a cross-sectional front view of the wafer carrier reconditioner apparatus in the retracted position showing a backing plate connected to a surface plate, with the various supply sources connected to the backing plate.

Referring now to the drawings, and more particularly to FIG. 1A, there is shown a front view cross section of the carrier reconditioner device, designated generally as reference numeral 10, positioned within a cleaning well 14. As embodied herein and referring to FIG. 1A, the reconditioner device 10 includes a surface plate 20, which may be of any suitable material, such as, for example, aluminum or stainless steel. As illustrated, the surface plate is approximately 8" in diameter and approximately ¼" thick. It is apparent, however, that various surface plate thicknesses may be employed depending on the rigidity of the underlying material.

Figure 2A:
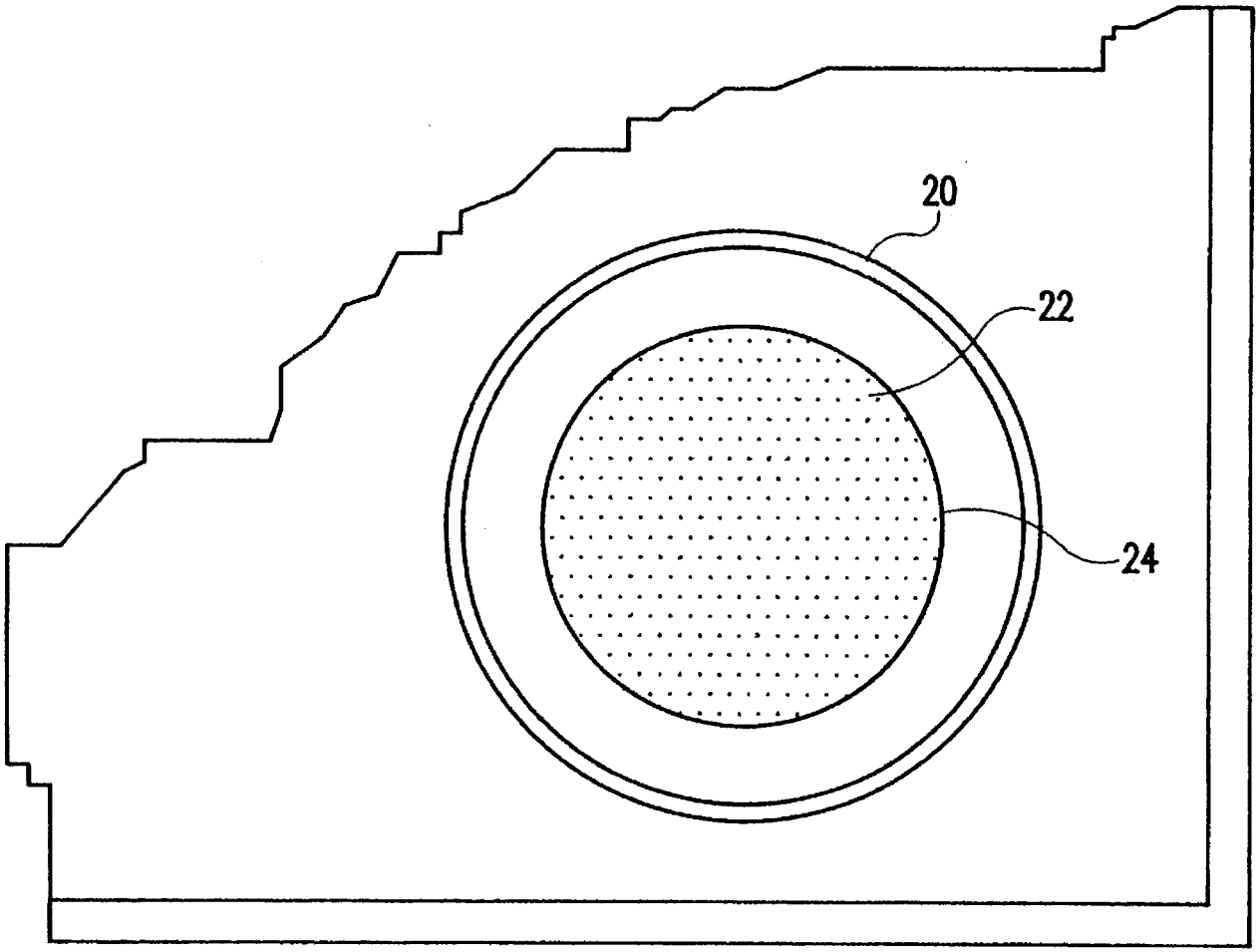
FIG. 2A is a top view of the reconditioner apparatus showing the top surface of the surface plate with a thin perforated film fixed thereto.

As shown in FIG. 2A, the surface plate contains a plurality of perforations 22. These perforations 22 extend throughout the width of the plate, that is, from the upper to lower surface of the surface plate. In addition, a thin perforated film 24, such as for example, DF-200 (or comparable film) is placed on the upper surface of the surface plate 20.

Figure 2B:
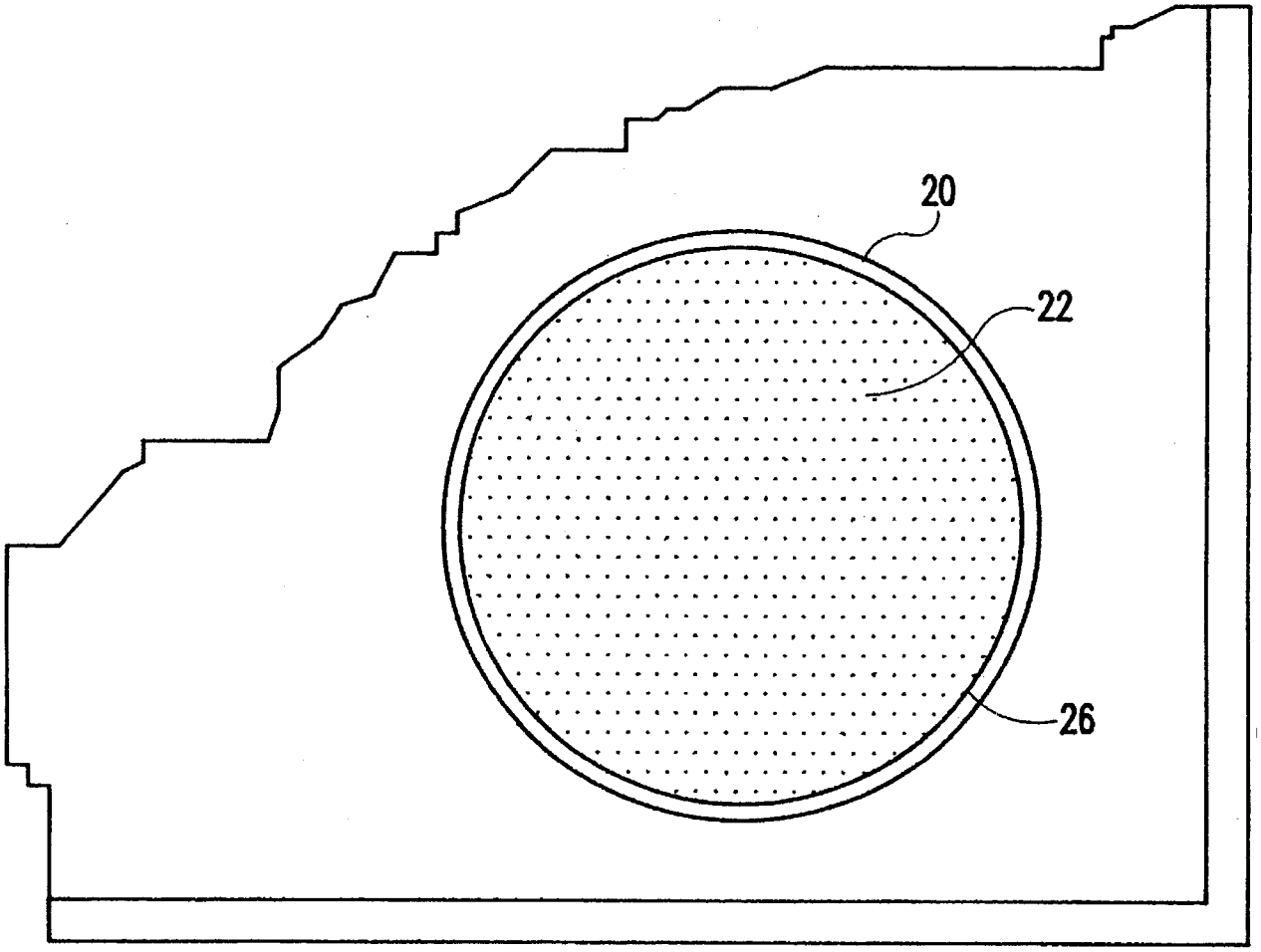
FIG. 2B is a top view of an alternate embodiment of the reconditioner apparatus in FIG. 2A showing the top surface of the surface plate with a perforated embossed glass plate fixed thereto.

Alternatively, a perforated embossed glass plate 26 may be substituted for the thin perforated film as shown in FIG. 2B. To accomplish the mounting of the glass plate, an approximately 3⅝" radius of the upper surface of the surface plate can be milled down about ⅛". A perforated embossed glass plate, about 3/16" thick, can then be fixed to the top of the plate.

Referring again to FIG. 1A, there is shown a backing plate 30 connected to one surface of the surface plate 20. The backing plate 30 may be of any suitable material, such as, for example, aluminum or stainless steel. The backing plate is fitted for connection to a cleaning solution source 32 and a vacuum supply 34. A separate water supply 33 may also be connected to the backing plate. In addition, a nitrogen supply 35, a compressed air supply 36, or both, may be fitted for connection to the backing plate.

Figure 1B:
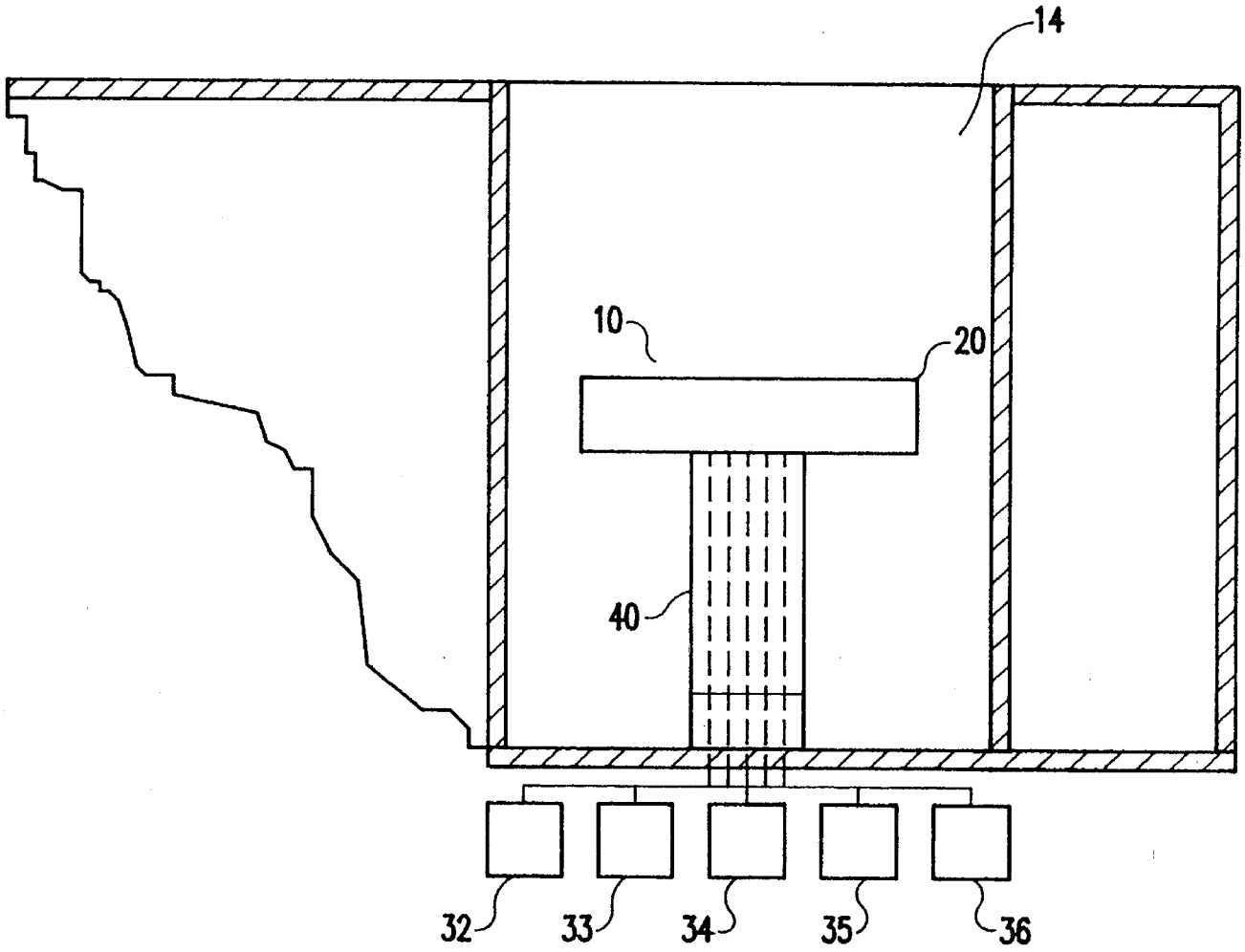
FIG. 1B is a cross-sectional front view of an alternate embodiment of the wafer carrier reconditioner apparatus in FIG. 1A, where the functions of the backing plate have been incorporated into the surface plate.

As shown in FIGS. 1A and 1B, the supply connections 32–36 enter the lower portion of the backing plate. It is apparent, however, that other connection arrangements are contemplated that achieve the same function, for example, having the supply connections at one or both sides of the backing plate.

Generally, de-ionized water would be used as the cleaning solution source. However, the cleaning solution may comprise a mixture of isopropyl alcohol and de-ionized water, or it may comprise any cleaning solution considered as favorable towards breaking down and drawing away those contaminants deposited on the carrier backing film during processing.

The nitrogen supply 35 may be utilized, if necessary, to blow away hardened particles, as well as aid in drying the carrier backing film. The compressed air supply 36 can be used in a manner similar to the nitrogen supply.

A separate backing plate 30 as shown in FIG. 1A may not be necessary since the operations and function of the backing plate 30 may be incorporated into, and be part of, a single surface plate assembly. See FIG. 1B. However, it may be advantageous to have separable backing and surface plates to aid in cleaning the dried slurry from the internal chambers or perforations if desired.

Figure 3:
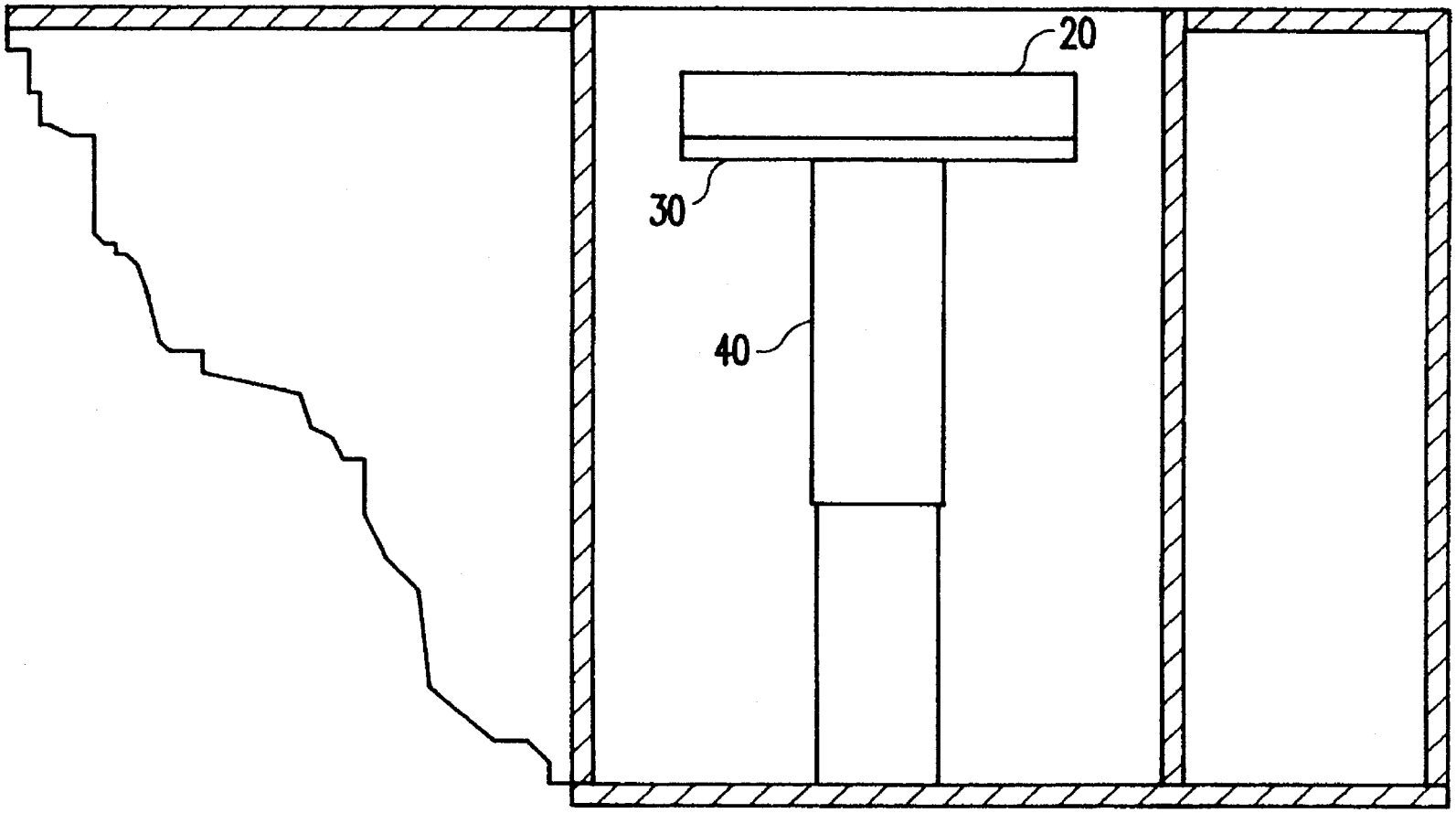
FIG. 3 is a cross-sectional front view of the carrier reconditioner in the extended position.

Continuing on with reference to FIG. 1A, there is shown a contacting means 40, connected to one surface of the backing plate 30, which serves as the extension and retraction mechanism for the surface plate 20. The surface plate 20 is in the retracted position as shown in FIG. 1A, and in the extended position as shown in FIG. 3. While FIGS. 1A and 3 show the contacting means in a vertical orientation for extension and retraction of the surface plate, the apparatus and method described herein are not limited to such a vertical orientation. Indeed, the present invention can function in either a vertical or horizontal orientation, or any angle therebetween.

Figure 4:
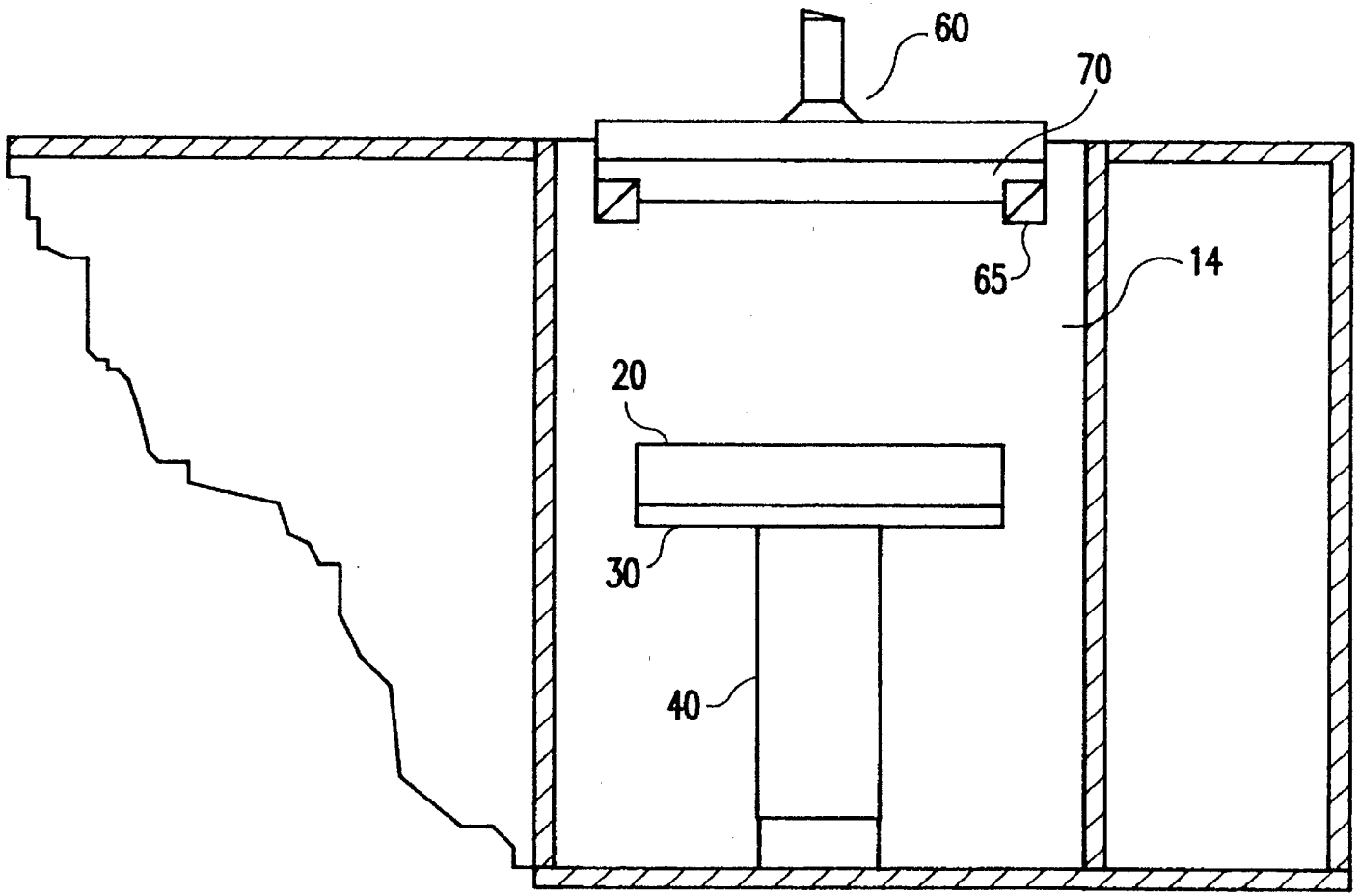
FIG. 4 is a cross-sectional front view of the carrier reconditioner in the retracted position showing the introduction of the wafer carrier.

In FIG. 4, wafer carrier 60 is shown with carrier backing film 70. The wafer carrier in FIG. 4 is shown after the wafer carrier is brought to the cleaning station and lowered within the cleaning well 14 following a wafer unload cycle. The wafer retaining ring 65 would normally hold the wafer in place during the previous polishing operation.

The method of reconditioning the carrier backing film, which utilizes the above reconditioning apparatus, will now be described. Following a wafer unload cycle, the wafer carrier 60 is brought to the cleaning station and lowered within the well 14. The reconditioning interval for the carrier backing film is variable and highly process dependent, ranging from reconditioning after every wafer is processed, to reconditioning after any selected number of wafers have been processed. The final carrier backing film reconditioning interval will depend, among other factors, on the slurry residuals produced in the prior polishing process, wafer production flow constraints (since each reconditioning interval takes a certain amount of time), and the threshold level of polish uniformity that is acceptable to the wafer processor.

The reconditioning method of the present invention commences by applying a cleaning solution to the carrier backing film, via a spray from the cleaning solution supply 32 that exists from the perforations 22 in the surface plate. As discussed above, de-ionized water, a mixture of isopropyl alcohol and de-ionized water, or other acceptable cleaning solution may be utilized. Therefore, depending on the desired cleaning solution, cleaning solution supply 32 and water supply 33 may be used separately or in conjunction during the rinse cycle.

While in this rinsing cycle, the surface plate can be in the retracted position as shown in FIG. 4, or if greater pressure is desired, the surface plate may be raised in closer proximity to the carrier. The spray of water or cleaning solution serves to rinse slurry deposits from the carrier backing film. This rinse and cleaning cycle typically lasts for 20 to 30 seconds, but may be more or less depending on the level of deposits on the carrier backing film.

Figure 5:
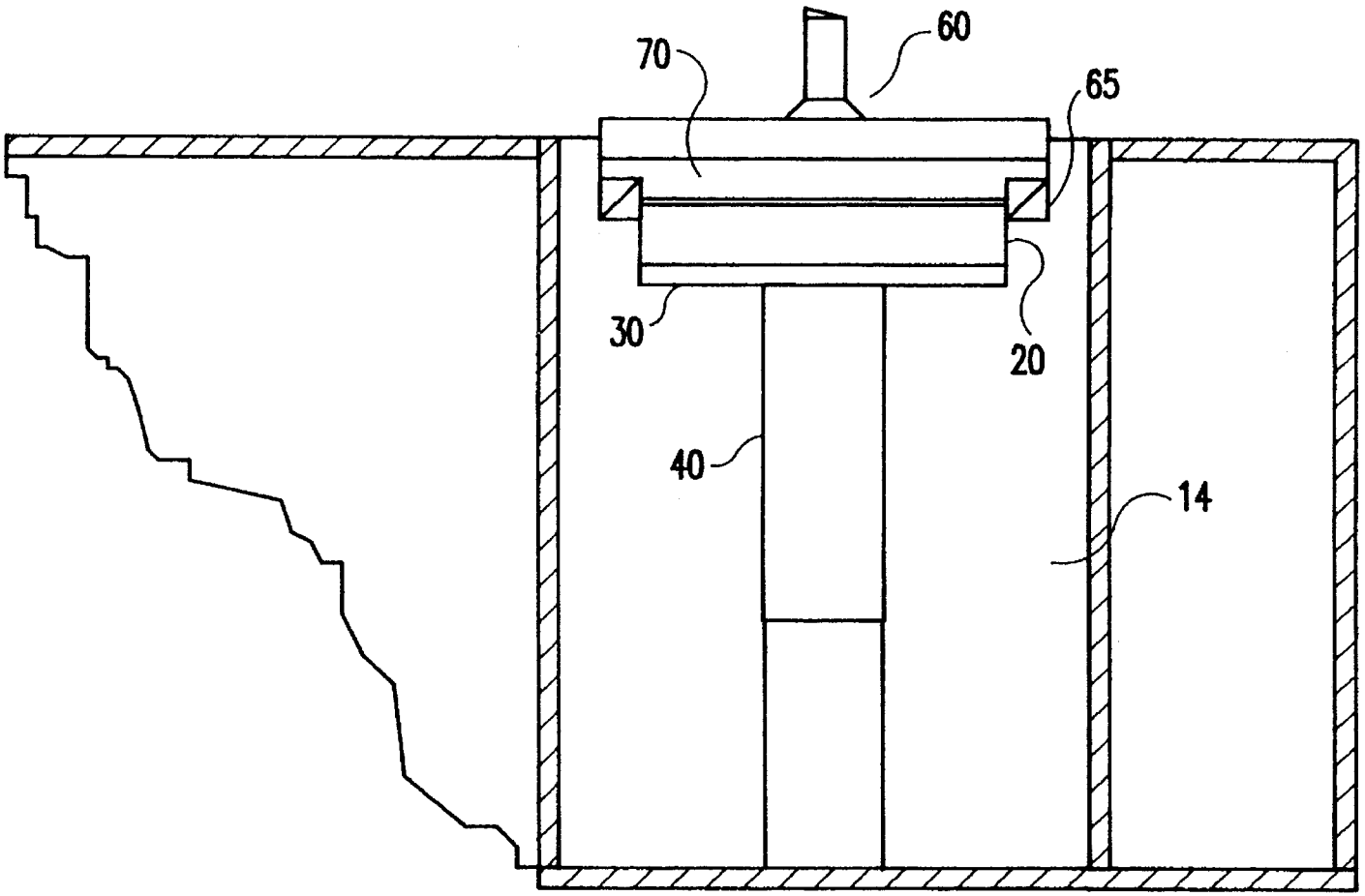
FIG. 5 is a cross-sectional front view of the carrier reconditioner in the extended position showing the mating of the film on the surface of the surface plate with the carrier backing film.

Following the rinse cycle, the surface plate 20 is extended by the contacting means 40 until the thin film 24 or embossed glass plate 26 on the surface plate makes sealed contact with the carrier backing film 70 as shown in FIG. 5. A vacuum is then applied via a vacuum supply connection 34 (see e.g. FIG. 1A) through the perforations 22 in the surface plate 20. The vacuum operation performs two functions. First, the resulting vacuum serves to "press" the carrier backing film 70, thereby redistributing its membrane and any water content uniformly throughout. Second, application of the vacuum also serves to draw out any possible buildup of slurry residuals and excessive water content from within the porous cavities of the carrier backing film's membrane, especially if the membrane is of sponge-like construction.

In the final step, the surface plate 20 is retracted by the contacting means 40 thereby separating the surface plate from the wafer carrier. This allows the carrier backing film to expand or reconstitute itself as the material draws in surrounding air as it breaks the vacuum hold.

The nitrogen supply 35, the compressed air supply 36, or both, may be utilized, if necessary, to blow away hardened particles as well as aid in drying the carrier backing film. Depending on the amount of buildup and type of slurry residuals resident in the film, the nitrogen supply 35 can be used before the vacuum step, after the vacuum step, or both, to blow away hardened particles and aid in drying. The compressed air supply 36 can be used in manner similar to the nitrogen supply.

Figure 6:
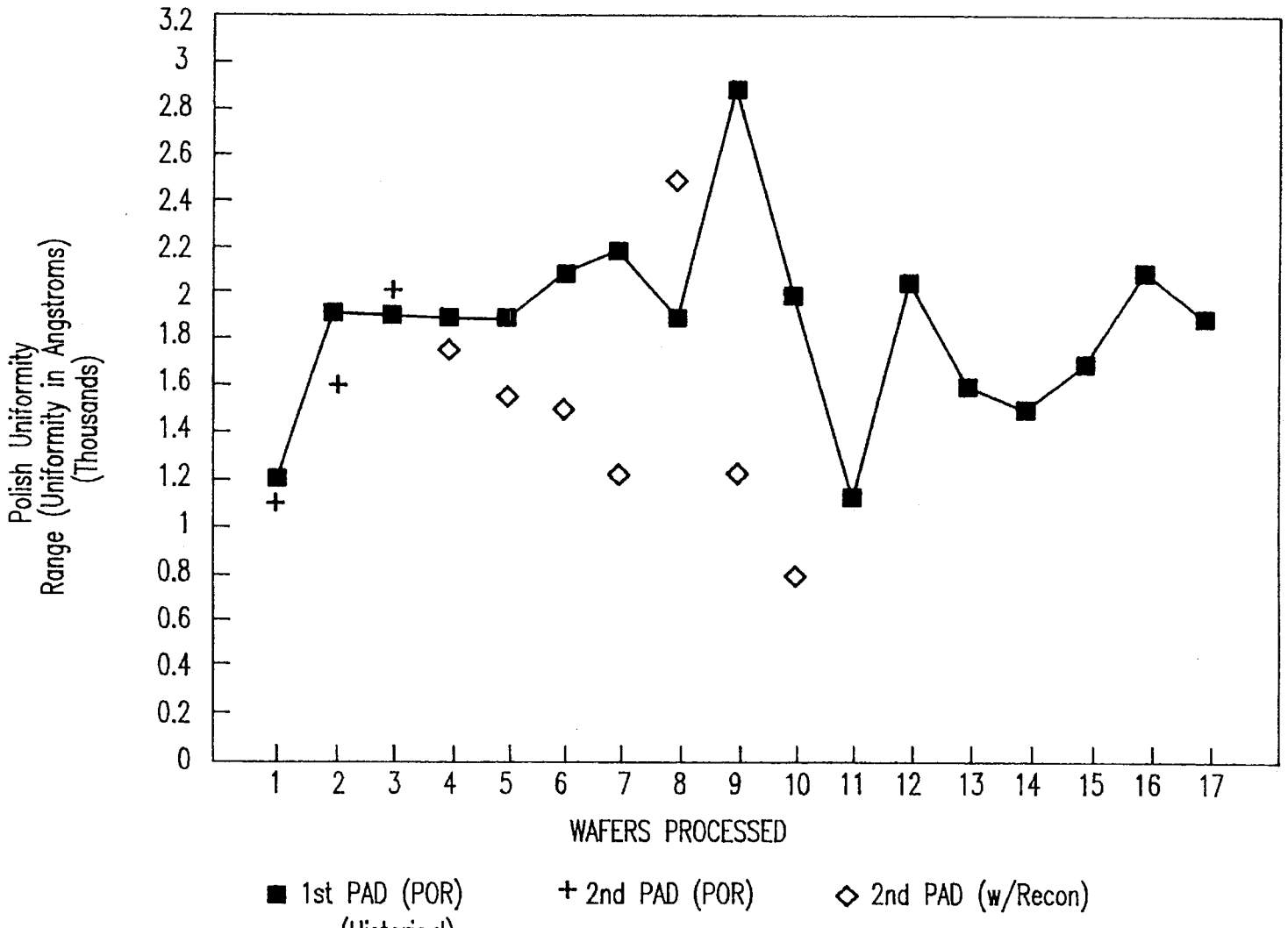
FIG. 6 is a graph of polish uniformity range as a function of the number of wafers processed and showing a process trend.

FIG. 6 is a graph showing the wafer polish uniformity range as a function of the amount of wafers processed, in which the process trend for a first historical process of record—1ST PAD (POR)—is compared to a second process in accordance with the present invention—2ND PAD (POR) and 2ND PAD (w/Recon)—where the carrier backing film (DF-200) has been reconditioned between the polishing operations.

Assuming an acceptable range of polish uniformity of less than 2000 Å for a finished wafer, it can be seen from FIG. 6 that this threshold was exceeded several times utilizing the first historical POR (the line using "solid squares" as data points) when no reconditioning of the carrier backing film was performed between polishing operations. The majority of the data points were in the 1600–2200 Å range.

The process according to the present invention was performed using two reconditioning intervals. In the first sequence (the line designated 2ND PAD (POR) using "+" as data points), the carrier backing film was reconditioned prior to the start of the run and then reconditioned after the third wafer was processed. In the second sequence, starting with the fourth wafer processed (the line designated 2ND PAD (w/Recon) using "diamonds" as data points), the carrier backing film was reconditioned after every wafer.

The advantages of the reconditioning the wafers between runs according to the present invention is readily shown in FIG. 6 (2ND PAD (w/Recon)). First off, out of seven wafers processed (runs 4–10), the 2000 Å threshold for polish uniformity was exceeded only once. In addition, the uniformity or planarity of the polished layer was "enhanced", that is, the range of the polish thickness across the wafer was reduced, as indicated by the decreasing slope of the process trend line. Moreover, the majority of the data points were below 1500 Å, with one as low as 800 Å. The lower the value of polish uniformity range, the greater the planarity.

As compared to the first historical process, therefore, not only did the reconditioning device and method according to the present invention reduce the absolute amount of polished wafers found to be unacceptable, but also the uniformity and planarity of the polished layer was enhanced across the wafers that were acceptable.

The film reconditioning interval is dependent on the process conditions, the production run times available, and the slurries generated in the polishing operations. For example, using the second process as shown in FIG. 6, it is apparent that reconditioning after each wafer processed produced a better result than reconditioning after the third wafer, although both intervals produced "acceptable" ranges of polish uniformity and planarity.

While the invention has been described in terms of the embodiments described above, those skilled in the art will recognize that the invention can be practiced with modification within the spirit and scope of the appended claims.

Having thus described my invention, what I claim as new and desire to secure by Letters Patent is as follows:

1. A method of reconditioning a carrier backing film that is attached to a wafer carrier, following a wafer unload cycle, the method comprising the steps of:

applying a spray of a cleaning solution to the carrier backing film through a perforated surface plate so as to rinse slurry deposits from the carrier backing film, said surface plate having a flat perforated material on its surface;

extending the surface plate to make sealed contact with the wafer carrier, whereby the flat perforated material on the surface plate and the carrier backing film are in contact;

initiating a vacuum condition which presses the carrier backing film, thereby redistributing its membrane and any water content uniformly throughout, and drawing out slurry residuals and excessive water content from within the carrier backing film; and retracting the surface plate, thereby separating the carrier backing film from the surface plate so as to provide an expansion of the carrier backing film as the material draws in surrounding air to break the vacuum condition.

2. The method recited in claim 1, wherein the cleaning solution is one of de-ionized water or a mixture of de-ionized water and isopropyl alcohol.

3. The method recited in claim 1, wherein the flat perforated material is one of a flat film or an embossed glass plate.

4. The apparatus recited in claim 1, wherein the film is of sponge-like construction.

5. An apparatus for reconditioning a carrier backing film on a wafer carrier used in chemical-mechanical polishing of semiconductor wafers, comprising:

means for applying a spray of cleaning solution to said carrier backing film, said means for applying including a perforated surface plate for rinsing a plurality of slurry deposits and a water content from said carrier backing film, and said means for applying including a flat perforated material positioned on said surface plate;

means for extending said surface plate for forming a sealed contact between said flat perforated material and said carrier backing film;

means for initiating a vacuum condition for pressing said carrier backing film for redistributing said carrier backing film and said water content within said carrier backing film, said means for initiating a vacuum being further for removing an excess of said slurry deposits and said water content from said carrier backing film; and means for retracting said surface plate for separating said carrier backing film from said surface plate for expanding said carrier backing film.

* * * * *